US010405603B2

(12) United States Patent
Vallon et al.

(10) Patent No.: US 10,405,603 B2
(45) Date of Patent: Sep. 10, 2019

(54) AUGMENTED HEEL CUP PROTECTIVE INSERT DEVICE FOR SHOES

(71) Applicants: Richard Vallon, Belmont, MA (US); Colleen Moira Carney, Belmont, MA (US)

(72) Inventors: Richard Vallon, Belmont, MA (US); Colleen Moira Carney, Belmont, MA (US)

( * ) Notice: Subject to any disclaimer, the term of this patent is extended or adjusted under 35 U.S.C. 154(b) by 51 days.

(21) Appl. No.: 15/696,088

(22) Filed: Sep. 5, 2017

(65) Prior Publication Data

US 2018/0064204 A1 Mar. 8, 2018

Related U.S. Application Data

(60) Provisional application No. 62/383,352, filed on Sep. 2, 2016.

(51) Int. Cl.

| | |
|---|---|
| ***A43B 23/28*** | (2006.01) |
| ***A43B 7/24*** | (2006.01) |
| ***A43B 7/14*** | (2006.01) |
| ***A43B 23/17*** | (2006.01) |
| ***A43B 23/08*** | (2006.01) |

(52) U.S. Cl.

CPC ..... *A43B 7/24* (2013.01); *A43B 7/14* (2013.01); *A43B 7/1405* (2013.01); *A43B 23/088* (2013.01); *A43B 23/17* (2013.01); *A43B 23/28* (2013.01)

(58) Field of Classification Search

CPC ..... A43B 7/14; A43B 7/1405; A43B 23/088; A43B 23/28

USPC ..... 36/58.5, 58.6, 69

See application file for complete search history.

(56) References Cited

U.S. PATENT DOCUMENTS

| | | | | | |
|---|---|---|---|---|---|
| 460,600 | A | * | 10/1891 | Sargent | A43B 23/28 36/58.5 |
| 1,155,209 | A | * | 9/1915 | Burke | A43B 23/28 36/58.5 |
| 1,397,095 | A | | 11/1921 | Hamilton | |
| 1,812,622 | A | * | 6/1931 | Costello | A43B 23/28 36/58.5 |
| 1,878,419 | A | * | 9/1932 | McCarthy | A43B 23/28 36/58.5 |
| 1,926,818 | A | * | 9/1933 | Rateliff | A43B 23/28 36/58.5 |

(Continued)

FOREIGN PATENT DOCUMENTS

| | | |
|---|---|---|
| RU | 141264 U1 | 5/2014 |
| WO | 2018045391 A1 | 3/2018 |

OTHER PUBLICATIONS

"Int'l Application Serial No. PCT/US17/50143, Int'l Search Report and Written Opinion dated Jan. 11, 2018", 6 pages.

*Primary Examiner* — Marie D Bays

(74) *Attorney, Agent, or Firm* — Kwan & Olynick LLP

(57) ABSTRACT

In general, certain embodiments of the present disclosure provide an augmented heel cup protective insert device for shoes. The insert device includes a posterior segment corresponding to the curvature of a heel of a shoe. The device also includes a medial wing, a medial parabolic formation that extends in a direction from top to bottom of the device, an inferior segment, and an angulated segment to meet the beginning of the edge of the heel on the medial side of the shoe.

20 Claims, 16 Drawing Sheets

(56) References Cited

U.S. PATENT DOCUMENTS

| | | | | | |
|---|---|---|---|---|---|
| 1,966,179 | A * | 7/1934 | Lesch | A43B 23/28 | 36/58.5 |
| 4,559,722 | A * | 12/1985 | Norton | A43B 5/06 | 36/105 |
| 4,910,886 | A | 3/1990 | Sullivan et al. | | |
| 5,449,005 | A | 8/1995 | Echols | | |
| 5,799,416 | A * | 9/1998 | Prober | A43B 23/28 | 36/58 |
| 5,842,292 | A * | 12/1998 | Siesel | A43B 23/28 | 36/58.5 |
| 5,946,825 | A | 9/1999 | Koh et al. | | |
| 6,079,128 | A * | 6/2000 | Hoshizaki | A43B 23/16 | 36/115 |
| 8,245,419 | B2 | 8/2012 | Echols | | |
| 8,590,178 | B2 | 11/2013 | Avar et al. | | |
| 8,745,899 | B2 * | 6/2014 | Schenone | A43B 3/26 | 36/97 |
| 9,345,287 | B2 | 5/2016 | Dananberg et al. | | |
| 2009/0100711 | A1 | 4/2009 | Engel | | |
| 2011/0088282 | A1 | 4/2011 | Dojan et al. | | |
| 2011/0173841 | A1 | 7/2011 | McDuff | | |
| 2012/0216422 | A1 | 8/2012 | Ikezawa et al. | | |
| 2015/0047227 | A1 | 2/2015 | Fallon et al. | | |
| 2017/0027285 | A1 * | 2/2017 | Mancini | A43B 23/28 | |
| 2017/0127762 | A1 * | 5/2017 | Birrell | A43B 7/1465 | |

* cited by examiner

100

AUGMENTED HEEL CUP PROTECTIVE INSERT DEVICE FOR SHOES

CROSS-REFERENCE TO RELATED APPLICATIONS

This application claims the benefit of U.S. Provisional Application No. 62/383,352, filed on Sep. 2, 2016, which is incorporated by reference herein in its entirety for all purposes.

TECHNICAL FIELD

The disclosed embodiments relate generally to orthotics.

BACKGROUND

In 2011, according to the American Orthopedic Society 45 Million Children are involved in Organized Sports. On an annual basis 2.5 million suffer injuries (almost 6%). Many of those injuries will have life long lasting effects. A Philadelphia Hospital reported Youth Sports related injuries increased by 400%, in one year. According to the US Product and Safety Commission Report from 1991 to 1998 Sports related injuries, among Baby Boomers, age 35 to 54, increased 33%. In 1998 the cost of 1 million sports related injuries to baby boomers was $18.7 billion. In 2011 injuries in youth and teen organized school sports was 3.5 million per year. Foot and Ankle injuries account for ⅓ of the annual injuries due to youth sports.

During activity the pressure exerted on the human heel is 3 times the individual's body weight. With increase in organized sport (NCAA team Sports) the amount of time each week is approximately 20 to 30 hours of practice and play. The American Orthopedic Foot & Ankle Society recommends that sport shoes should be replaced after 300 to 500 miles of running and 300 hours of aerobic exercise. Therefore, on the college level, athletes should be replacing their shoes every 2.5 to 3 months, totaling 4 times per year. For athletes competing year round in leagues or on a semi pro schedule, should be replacing their shoes a minimum of 5×/year. Various sports on the NCAA level I have worked with (e.g. Harvard Tennis) replace their shoes every 3 to 4 weeks.

In a random Foot Health Survey performed in 2013, 61% of participants are experiencing some form of foot pain or injury; 9.5% are in the ball of the foot; 9.5% are in the arch of the foot; 14% of the issues are in the ankle; and 28% of the injuries are in the heel.

One possible explanation for the foot injuries is the design of shoes themselves. The heel portions of the shoes for the athletes have no protection to prevent heels from injury. This may be because the shoes lacked padding between the insole and the foam rubber ankle padding in the heel of the shoe. In many shoes, the space between the insole and ankle padding is only constructed with a lining that covers a non-yielding heel cup made of hard plastic. The design of the heel cup allows the heel to have excursion and move freely. However, the space also allows the heel to move to the point of repetitive contact with the hard non-yielding heel cup of the shoe; thus causing the numerous injuries, such as blisters, calluses, heel fissures, friction burns, infections, plantar fasciitis, tendonitis, and bursitis.

Many over-the-counter remedies are ineffective, wear down easily, or are unreliable because they are built to be removable and replaceable. Therefore, there exists a need for an improved or augmented heel cup insert device for shoes that helps mitigate, prevent, or remedy foot injuries.

SUMMARY

The following presents a simplified summary of the disclosure in order to provide a basic understanding of certain embodiments of the present disclosure. This summary is not an extensive overview of the disclosure and it does not identify key/critical elements of the present disclosure or delineate the scope of the present disclosure. Its sole purpose is to present some concepts disclosed herein in a simplified form as a prelude to the more detailed description that is presented later.

In general, certain embodiments of the present disclosure provide an augmented heel cup protective insert device for shoes. The insert device includes a posterior segment corresponding to the curvature of a heel of a shoe. The device also includes a medial wing, a medial parabolic formation that extends in a direction from top to bottom of the device, an inferior segment, and an angulated segment to meet the beginning of the edge of the heel on the medial side of the shoe.

BRIEF DESCRIPTION OF THE DRAWINGS

Like reference numerals refer to corresponding parts throughout the drawings.

DESCRIPTION OF EMBODIMENTS

Figure 1A:
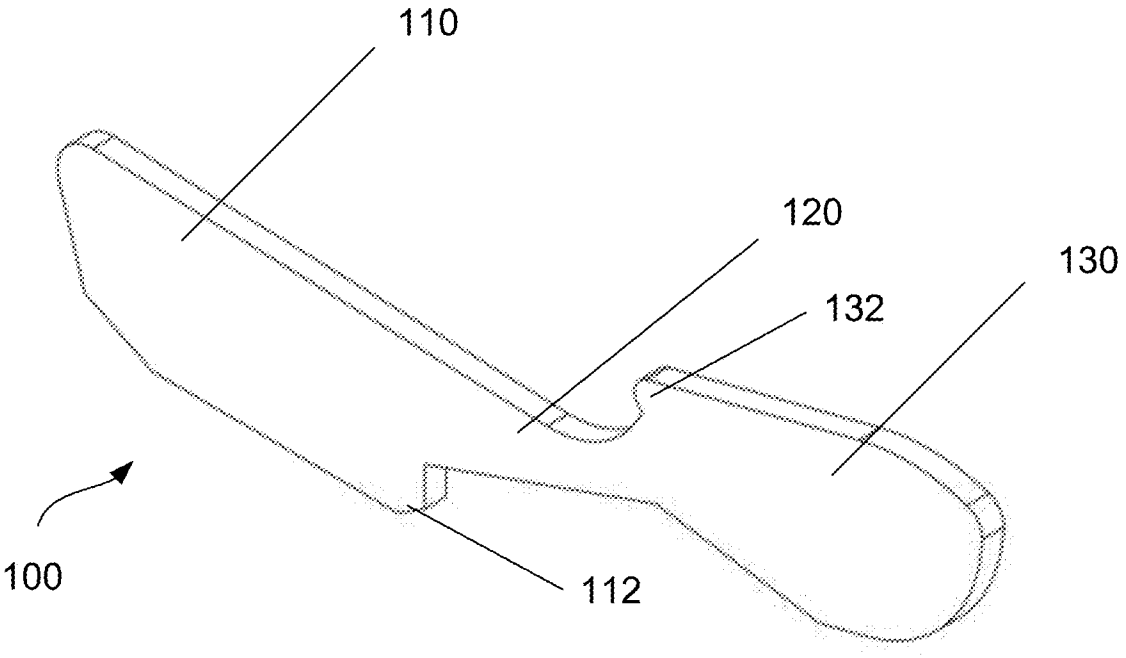
FIGS. 1A-1C illustrate one example of an augmented heel cup insert device in accordance with embodiments of the present disclosure.

It will be understood that, although the terms "first," "second," etc. may be used herein to describe various elements, these elements should not be limited by these terms. These terms are only used to distinguish one element from another. For example, a first contact could be termed a second contact, and, similarly, a second contact could be termed a first contact, without changing the meaning of the description, so long as all occurrences of the "first contact" are renamed consistently and all occurrences of the second contact are renamed consistently. The first contact and the second contact are both contacts, but they are not the same contact.

The terminology used herein is for the purpose of describing particular embodiments only and is not intended to be limiting of the claims. As used in the description of the embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined [that a stated condition precedent is true]" or "if [a stated condition precedent is true]" or "when [a stated condition precedent is true]" may be construed to mean "upon determining" or "in response to determining" or "in accordance with a determination" or "upon detecting" or "in response to detecting" that the stated condition precedent is true, depending on the context.

As used herein, "Aliplast" refers to: a firm malleable product used as a base to provide a semi-ridged platform for insoles. It is most often in conjunction with Plastazote for orthotics.

As used herein, "Poron" refers to: a flexible light-weight cushioning material with or without a backing of a fabric. It is of sturdy construction durable under stress. Poron is used as a base for insoles and orthotics and provides excellent cushioning protection.

As used herein, "Plastazote" refers to: a material designed to absorb pressure and cushioning frequently used in orthotics and prosthetics singularly or in combination. It is readily compressible and does not retain its original dimension. It comes in three grades of compression. It can be heat-moulded to accommodate anatomical shapes.

As used herein, "P.P.T." refers to: a very light, flexible and used extensively as a composite in the assembly of orthopedic devices including prosthetics although moderately durable it combines most often with other similar products for stability.

As used herein, "Foam Rubber" refers to: sponge foam and rubber. It is very soft on compression and presents with a bulky appearance. It is most often used to absorb pressure.

As used herein, "Neoprene" refers to: a combination of spongy rubber, used for palliative padding to absorb pressure and provide protection and comfort. It is well suited for the inclusion of orthotics and insoles. It is durable and retains its shape on pressure and flexible.

As used herein, "Felt" refers to: a blend of wool felt and cotton. It is tough and durable but mats down over time with pressure. Felt is used mostly in podiatric orthopedics for protective correction and palliative purpose and can be applied directly to skin surface.

As used herein, "Gel" refers to: a product of polythene designed to provide protection from pressure on joints of the foot. It has the consistency of jelly-fish and readily conforms to an irregular surface. It changes shape over time and absorbs pressure.

Most shoes are designed to protect the bottom/plantar surface of the heel, but not to protect the periphery of the heel. In various embodiments of the present disclosure, a unique design is presented that is contoured to the interior heel portion of the shoe. In some embodiments, the device is flexible and its purpose is for medial, posterior and lateral heel protection. In some embodiments, the device can be installed in front of the fabric lining, which covers the firm plastic heel cup. In other embodiments, the device is adhered to the shoe by being firmly cemented to the plastic heel cup directly (during manufacturing process), thus concealing its presence and yet performing the function of protection, comfort and alignment of the heel segment. In such embodiments, such a design provides additional collateral support for the heel itself.

In various embodiments, the overall dimensions including design, cut-outs, notches, extensions and pontoons are unique. Additional modifications may be added as conditions dictate. An example would be to add additional protection pontoons to enhance a snug fit and provide impact protection. In some embodiments, another enhancement would entail a crenature or notching of the most superior-posterior extension of the embodiment of our device. In such embodiments, this allows for flexibility on installation and cradling of the tendoachilles and heel component. In some embodiments, a similar cutout is presented inferiorly to facilitate ease of installation or adjustment.

Reference will now be made in detail to various embodiments, examples of which are illustrated in the accompanying drawings. In the following detailed description, numerous specific details are set forth in order to provide a thorough understanding of the present disclosure and the described embodiments. However, the present disclosure may be practiced without these specific details. In other instances, well-known methods, procedures, components, and circuits have not been described in detail so as not to unnecessarily obscure aspects of the embodiments. The following figures all present example left shoe insert devices in accordance with embodiments of the present disclosure. It should be noted that right shoe insert devices would simply be just mirror images of the examples presented.

FIGS. 1A-1C

Figure 1B:
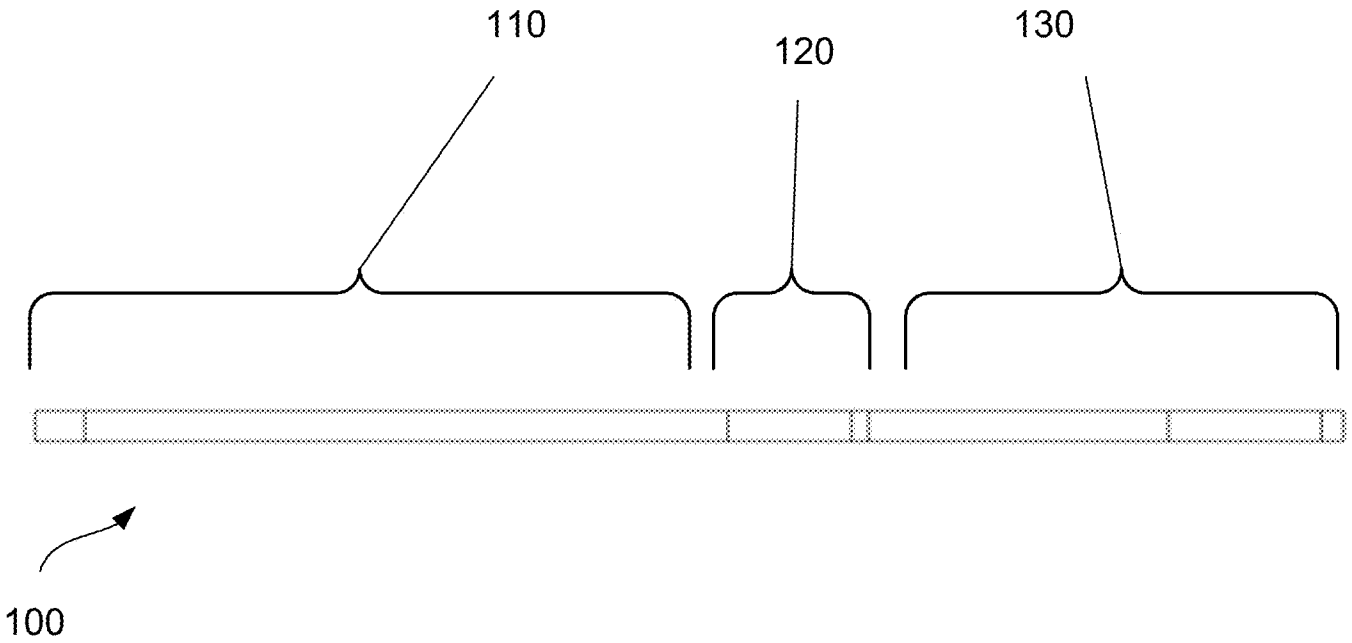
Figure 1C:
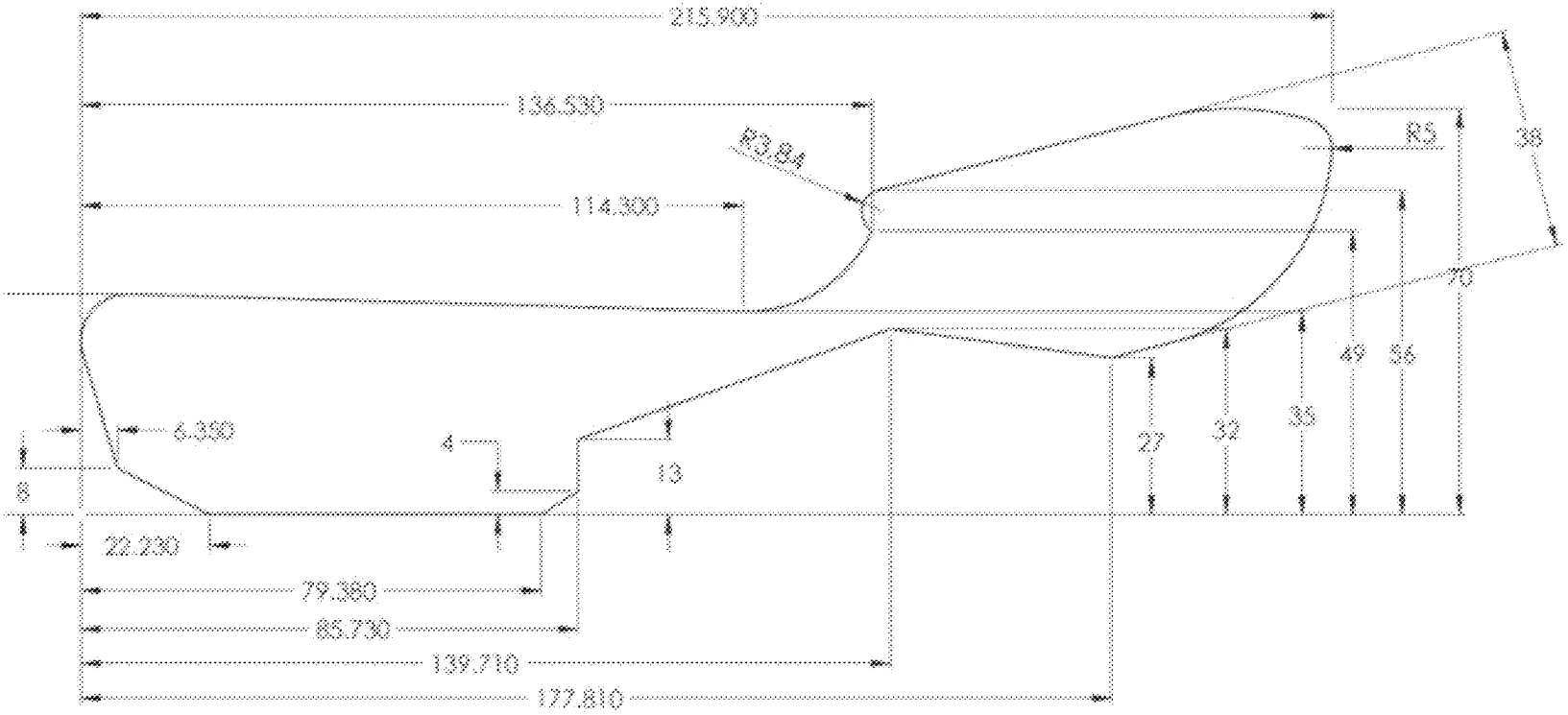

FIGS. 1A-1C illustrate one example of an augmented heel cup insert device in accordance with embodiments of the present disclosure. In various embodiments, the nature of the design shown in FIGS. 1A-1C is to mitigate friction, stress and shearing forces against the bulbous protrusions of the medial, posterior and lateral sides of the heel during activity.

In some embodiments, the insert device is designed to, cradle the heel with a firm cushion and limit heel excursion and rotation, which occurs naturally in the foot upon movement. It will reinforce stability and insure comfort. The device also adds durability to the shoe. In various embodiments, the device is installed discreetly between the hard plastic unyielding cup and fabric cover of the interior of the shoe as part of the construction of the shoe.

In FIG. 1A, insert 100 includes medial wing 130, which cushions directly against the rear of the heel on the medial/inside/arch side of the foot. In some embodiments, medial wing 130 is shaped to conform to plastic heel cups standard in most shoes. In some embodiments, medial wing 130 forms a parabolic formation Medial wing 130 is a stabilizing wing, providing stability to the foot during physical movement. Insert 100 also includes lateral wing 110. Lateral wing 110 cushions directly against the rear heel of the foot on the lateral/outside of the foot. In some embodiments, lateral wing 110 is longer than medial wing 130 because the lateral/outside of the heel contains more bony protrusions than the medial/inside. In addition, during physical movement (or even just standing), more pressure and force is exerted onto the lateral side of the heel. The combination of these two factors leads to a preponderance of complaints for foot pain being on the lateral side. In addition, the majority of skin lesions, fissures, blisters, and points of irritation are also located on the lateral side. Insert 100 also includes a middle section 120 for cupping the center rear of the heel. However, because the insert needs to bend to conform to standard sneakers, middle section 120 has a thinner vertical thickness than both the lateral and medial wings, in order to facilitate bending of the insert. In some embodiments, medial wing 130 includes a top corner protrusion 132, located diagonally across from bottom corner protrusion 112 of lateral wing 110. In such embodiments, these extra protrusions are located such that the insert cushions the heel in a way that naturally corresponds to the normal tubercle locations on human feet. In such embodiments, the natural tubercle tracking contour of insert 100 helps to prevent bursitis or any other painful condition arising from repeated pressure/rubbing of the tubercles against the hard plastic heel cup of the shoe. In various embodiments, the combination of the two wings provides improved protection of the heel during side-to-side motion.

FIG. 1B illustrates an edge view of insert 100. It should be noted that exemplar inserts typically have a thickness of 3.18 millimeters (mm), or ⅛ of an inch. FIG. 1C illustrates a view of insert 100 with example measurements in millimeters. All measurements presented as examples and are listed for general understanding purposes. It should be noted that the numbers presented do not limit or restrict embodiments of the disclosure to just the numbers listed. Real embodiments can have any combination of numbers as long as some of the same purposes or advantages of the insert device, as described herein, are achieved. In some embodiments, device 100 is made of Aliplast, Poron, Plastazote, P.P.T., Foam Rubber and/or Neoprene. Although, FIG. 1C depicts insert device 100 as being a total length 215.9 mm (which may fit shoe sizes 7-12 in men's or women's), in some embodiments, the length and overall proportions can be adjusted to fit any desired shoe size.

FIG. 1C illustrates, from 215.9 to 49, is the medial parabolic formation that extends in a direction from top to bottom of the device. From 49 to 177.81 represents the most inferior segment of the medial segment (or wing). From 177.81 to 139.71, device 100 is angulated to meet the beginning of the edge of the heel on the medial side of the shoe.

In some embodiments, the length of the device is designed to fit pre-existing confirmation of shoe designs. In various embodiments, the device is specifically designed to be a length that can encompass all the possible irritations to the heel. The lateral side is longer because it is the maximum point of pressure and irritation. The heel is vulnerable to multiple points of irritation during movement. Biomechanically the heel is first to initiate contact with the ground. The force which the heel absorbs is equal to three times the body weight. The maximum force is absorbed by the heel segment. When the heel comes in contact with the ground there is rotational movement; side to side and vertically. The invention contributes to the prevention of medical issues to the heel.

FIGS. 2A-2C

Figure 2A:
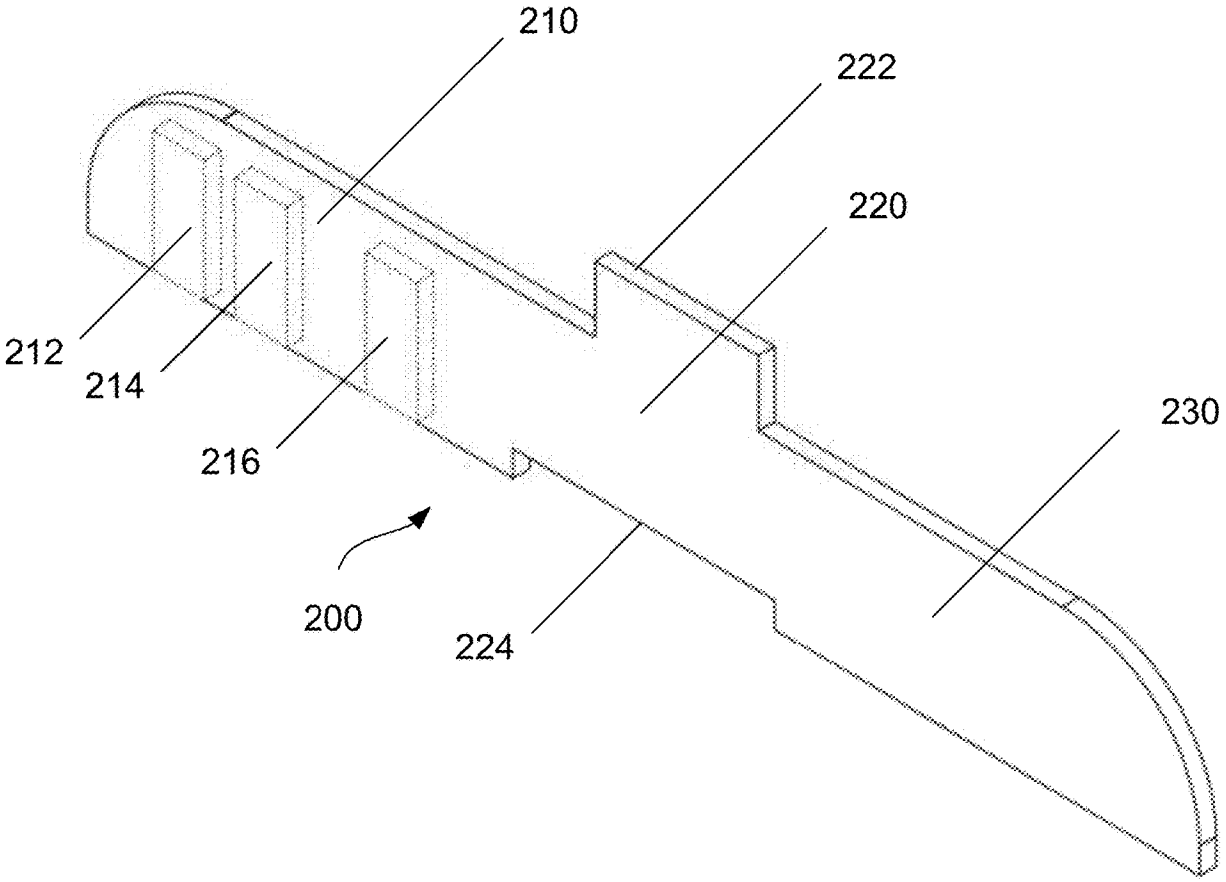
FIGS. 2A-2C illustrate another example of an augmented heel cup insert device in accordance with embodiments of the present disclosure.
Figure 2B:
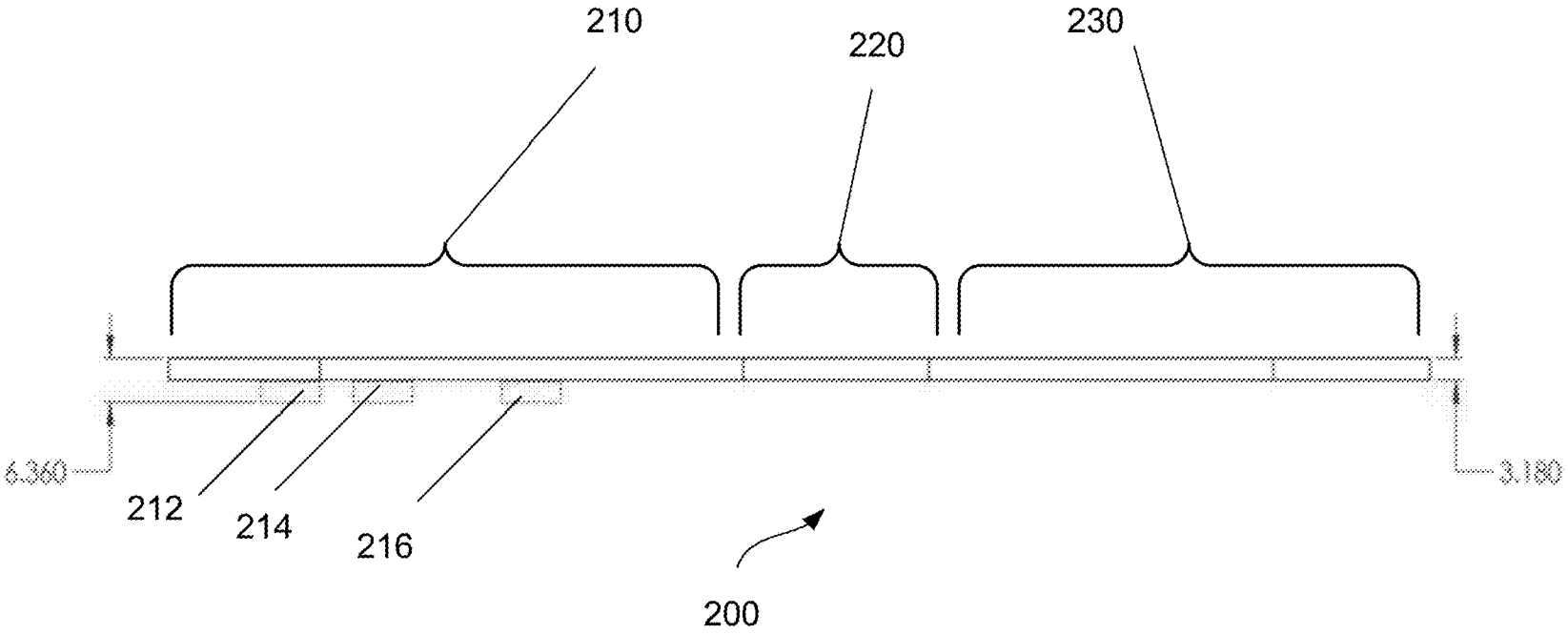
Figure 2C:
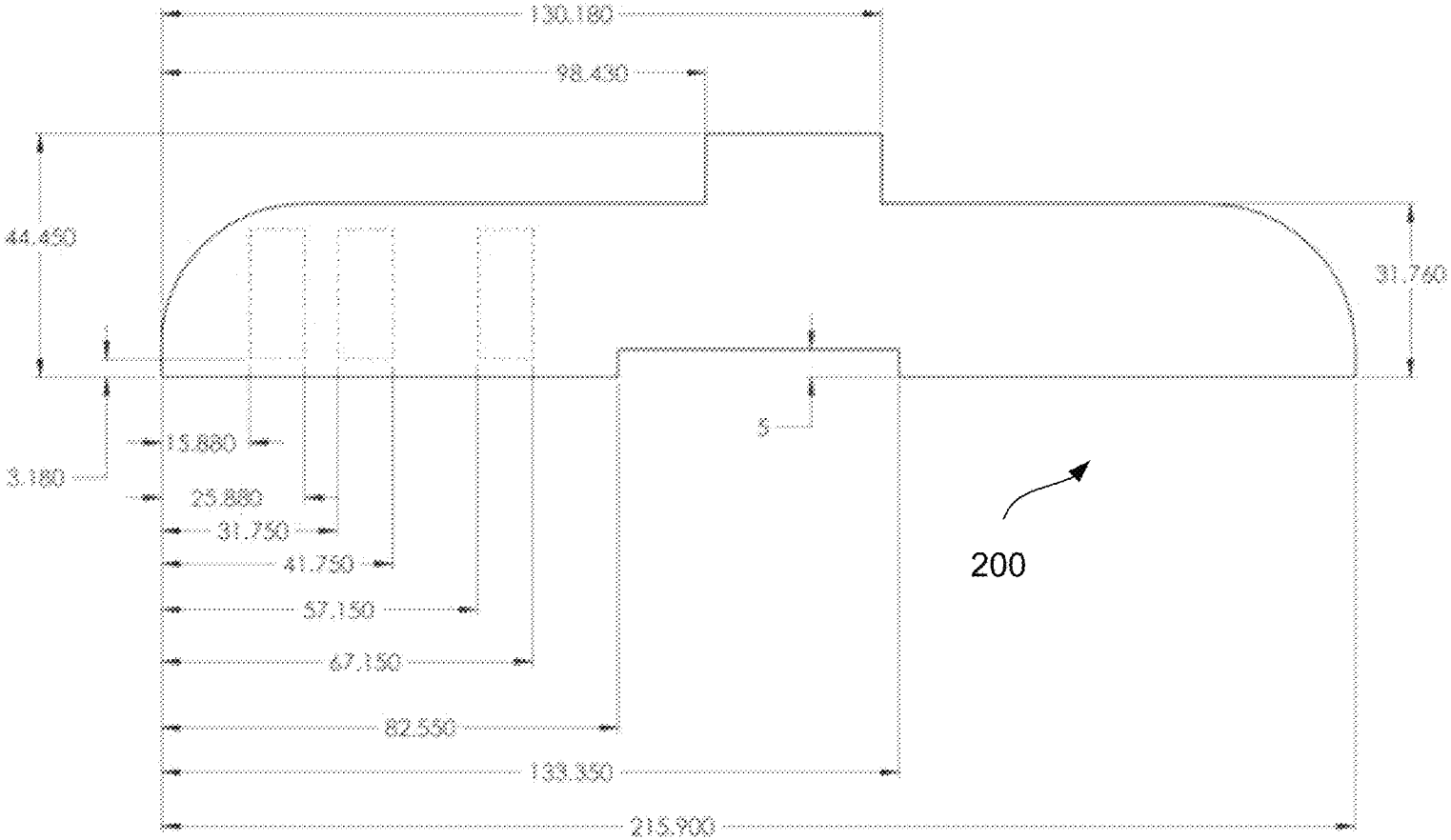

FIGS. 2A-2C also illustrate just one example of an insert device 200 in accordance with embodiments of the present disclosure. As with insert device 100, insert device 200 includes medial wing 230, lateral wing 210, and middle section 220. In addition, insert device 200 also includes a "cut out" 222 towards the bottom of middle section 220. In some embodiments, cut out 222 allows for the abutment of the factory installed insole. In other words, cut out 222 allows for the accommodation of the cup of the inner sole of the shoe. In such embodiments, cut out 222 was adapted to accommodate the rise in the heel portion on the insole of the manufactured product. In some embodiments, medial wing 230 also includes a parabolic end of the device in order to replicate the curvature of a factory installed plastic heel cup.

Middle section 220 includes a middle extension 222. In some embodiments, extension 222 is a square extension that provides comfort and protection to the attachment of the tendoachilles. In some embodiments, extension 222 is adapted for the flexibility on installation and further cradling of the tendoachilles segment. As can be seen from the figures, middle section 220 is much thicker vertically than middle section 120 of insert 100. This is to provide more stability for the insert device.

Lateral wing 210 adds comfort and protection to the top lateral side of the foot. In some embodiments, it prevents the foot from coming in direct contact with the un-yielding heel cup. In some embodiments, There are three "pontoons" 212, 214, and 216 situated on lateral wing 210. These pontoons are strategically placed to add comfort and protection to the most vulnerable areas of the lateral side of the foot. The placement of the pontoons is deliberate to correspond to the places on the foot that have been anatomically proven to have the most pressure on the heel from the plastic heel cup during movement. The pontoons straddle a calcaneal prominent tubercle on the lateral side called the "Lateral Process." It is this area which is most adversely pressured during motion and can result in multiple skin lesions. The most distal pontoon 212 adds ancillary protection to the soft tissue that is posterior to the cuboid bone. Middle pontoon 214 is positioned to directly protect the calcaneal (prominence) tubercle. Pontoon 216, the most proximal pontoon, is positioned to provide ancillary protection to the heel tissue, just posterior to the calcaneal tubercle.

In various embodiments, all three Pontoons are situated to cradle the prominent anatomical points of the foot, which when cradled are protected from abrasion and limit excursion. They are protective pressure concussion elements. In some embodiments, the pontoons are made of Felt, Aliplast, Poron, Plastazote, PPT, Neoprene, Foam Rubber or Gel. In some embodiments, the pontoons are around 1/16" or 1.59 mm, but not to exceed ⅛" or 3.18 mm in thickness.

As with FIG. 1B, FIG. 2B shows an edge view of insert 200. As with FIG. 1C, FIG. 2C provides example measurements for insert device 200. The example measurements are given in mm, but are not limiting for some embodiments of the present disclosure. Thus, real embodiments can have any combination of numbers as long as some of the same purposes or advantages of the insert device, as described herein, are achieved.

FIG. 3A-3C

Figure 3A:
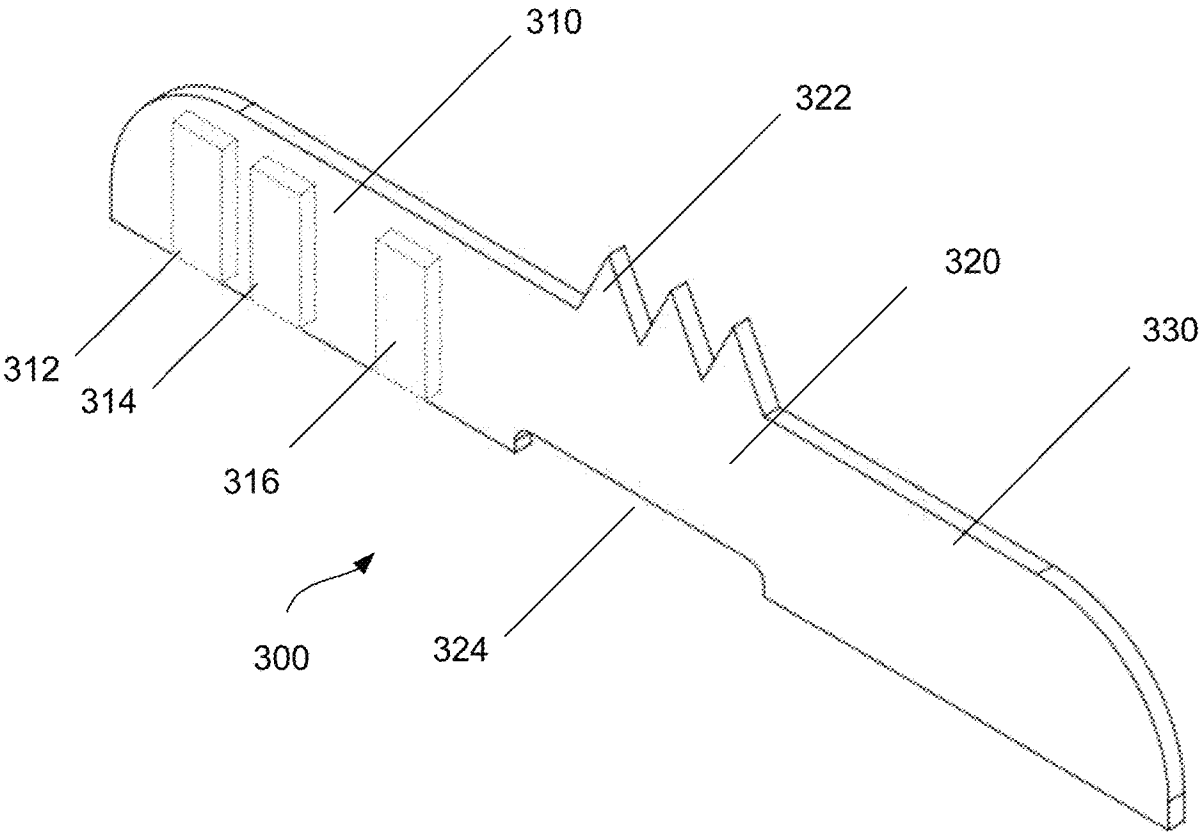
FIGS. 3A-3C illustrate another example of an augmented heel cup insert device in accordance with embodiments of the present disclosure.
Figure 3B:
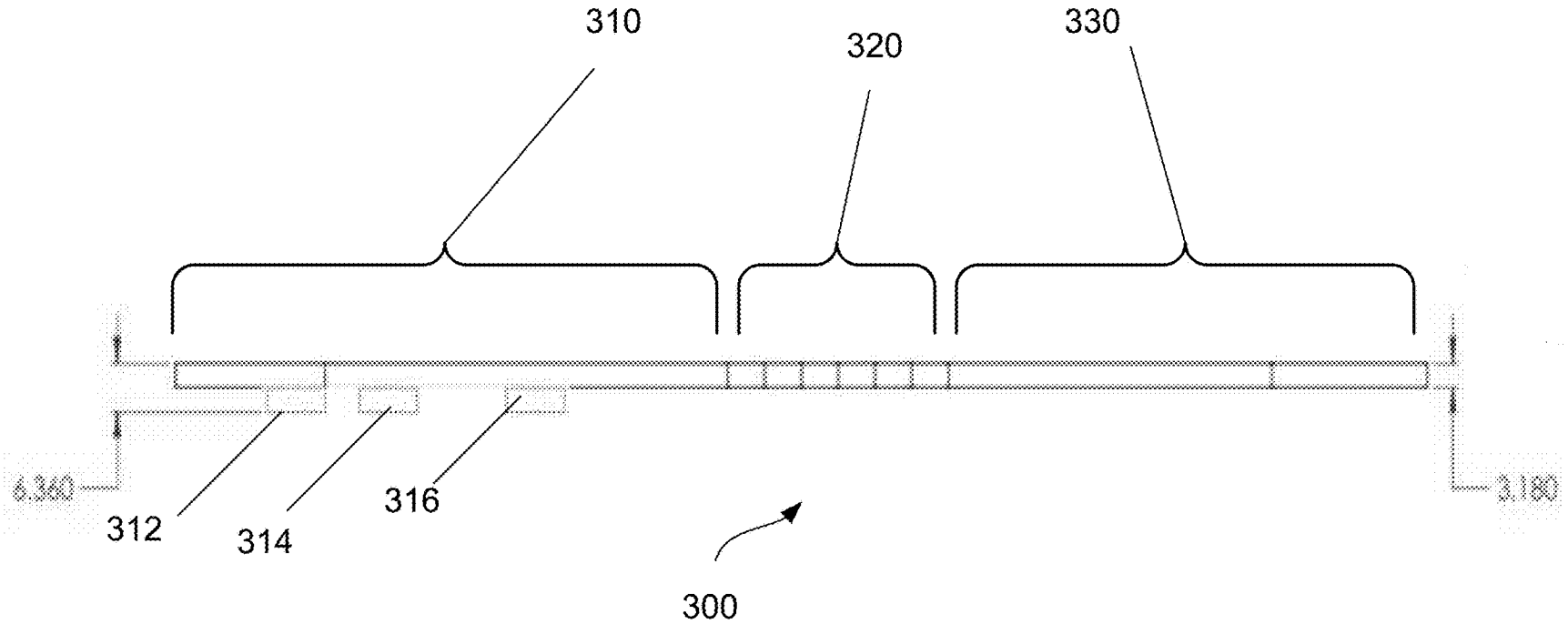
Figure 3C:
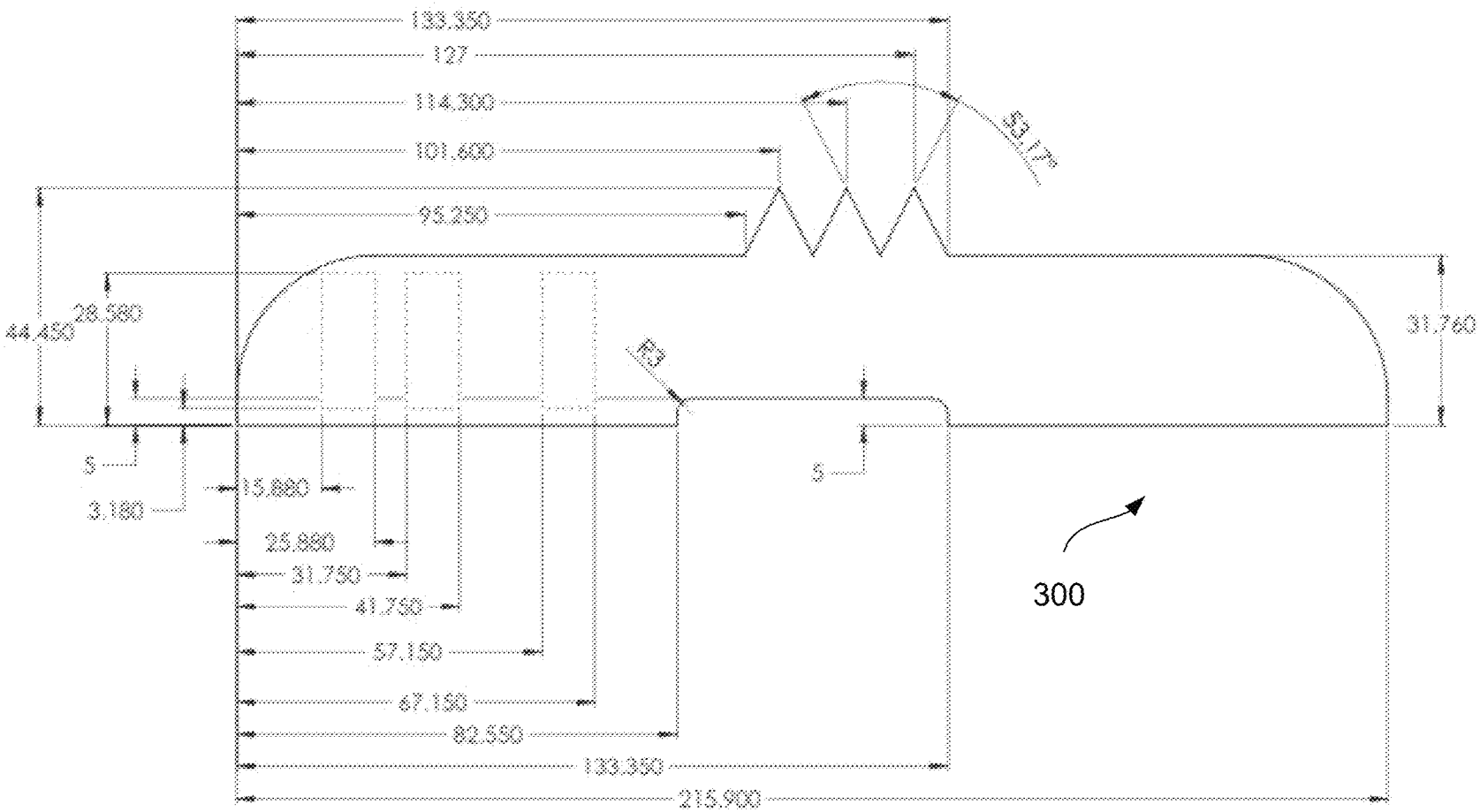

FIGS. 3A-3C illustrate just another example of an insert device 300 in accordance with embodiments of the present disclosure. Insert device 300 is similar in design to insert device 200. Insert device 300 includes medial wing 330, middle section 320, lateral wing 310, cut out 324, and pontoons 312, 314, and 316. In addition, instead of middle extension 222, insert device 300 includes triangles 322 on the superior (top) edge of middle section 320. In some embodiments, insert device 300 includes three triangles 322 that provide flexibility on installation while allowing for expansion and contraction when the shoe is being worn. Like extension 222, there is still comfort and protection given to the attachment of the tendoachilles. However, an advantage over the square extension 222 is that triangles 322 adapt well to the top surrounding area of the rear of the shoe for further cradling of the tendoachilles segment. In some embodiments, pointed triangles 322 are designed to fit underneath/behind the sponge foam collar that runs around the periphery at the top of the shoe, which is standard on many manufactured sneakers. In some embodiments, there are three triangles because the middle triangle sits directly on the tendoachilles while the two triangles on each side fit into the natural grooves/indentations of each side of the tendoachilles.

In some embodiments, the triangular shapes are designed to absorb the "wave-like" side-to-side movement of the foot during movement. The spacing of the pointed tips of the triangles absorb the movement and sway along with the absorbed movement while the rest of insert 300 stays stable and still. This prevents tearing of the insert caused by exposure to the swaying movement because the maximum amount of movement against a shoe occurs toward the top of the heel, not the bottom/plantar surface. This is because the plantar surface is at least partially stabilized by the weight of the wearer.

As with FIG. 1B, FIG. 3B shows an edge view of insert 300. As with FIG. 1C, FIG. 3C provides example measurements for insert device 300. The example measurements are given in mm, but are not limiting for some embodiments of the present disclosure. Thus, real embodiments can have any combination of numbers as long as some of the same purposes or advantages of the insert device, as described herein, are achieved.

FIG. 4A-4C

Figure 4A:
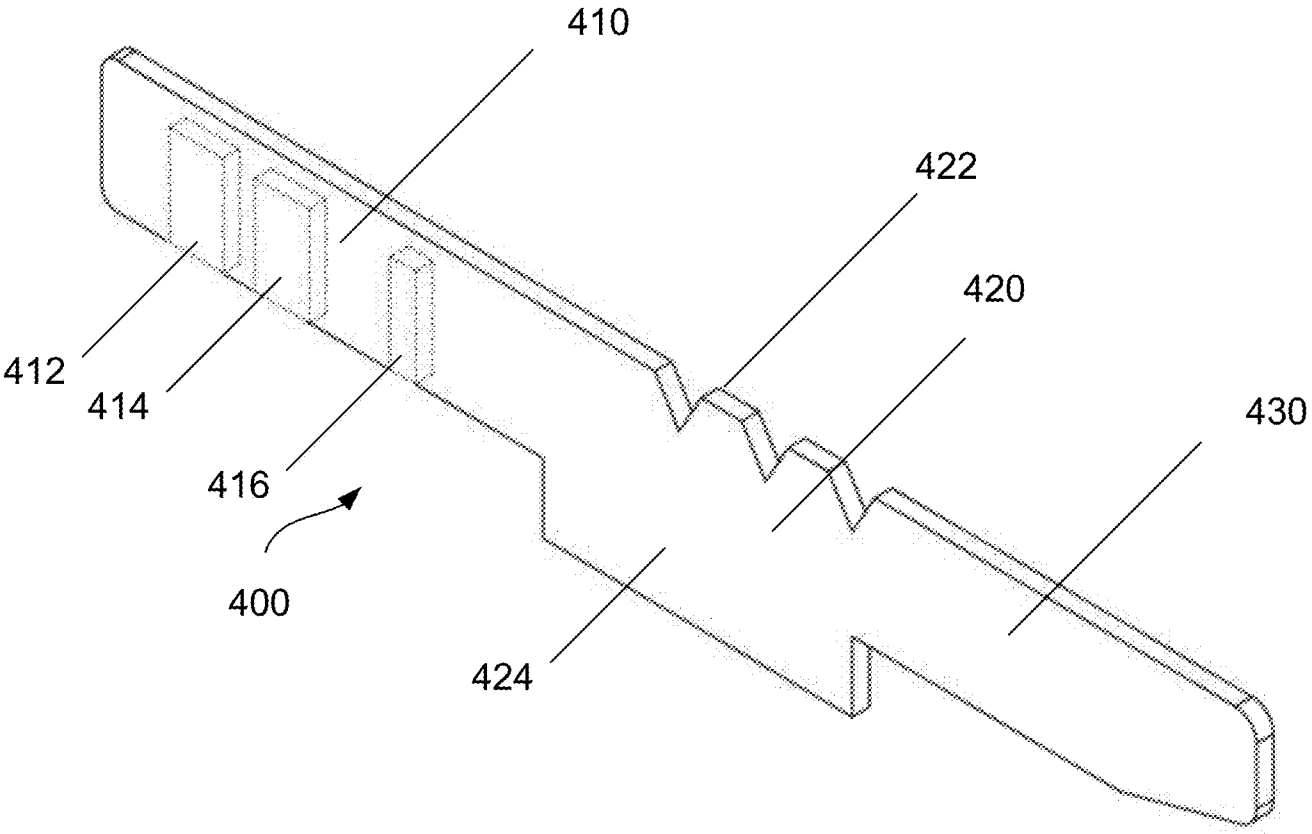
FIGS. 4A-4C illustrate another example of an augmented heel cup insert device in accordance with embodiments of the present disclosure.
Figure 4B:
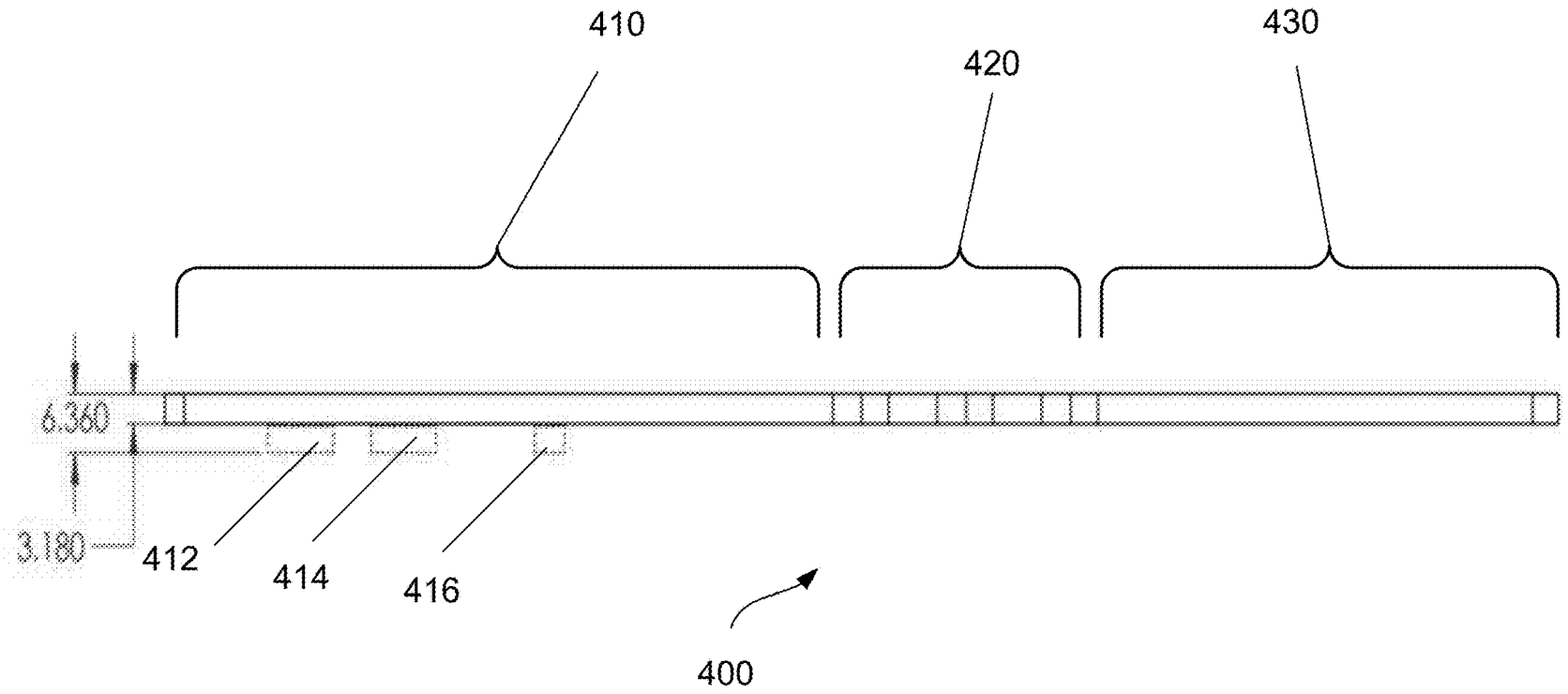
Figure 4C:
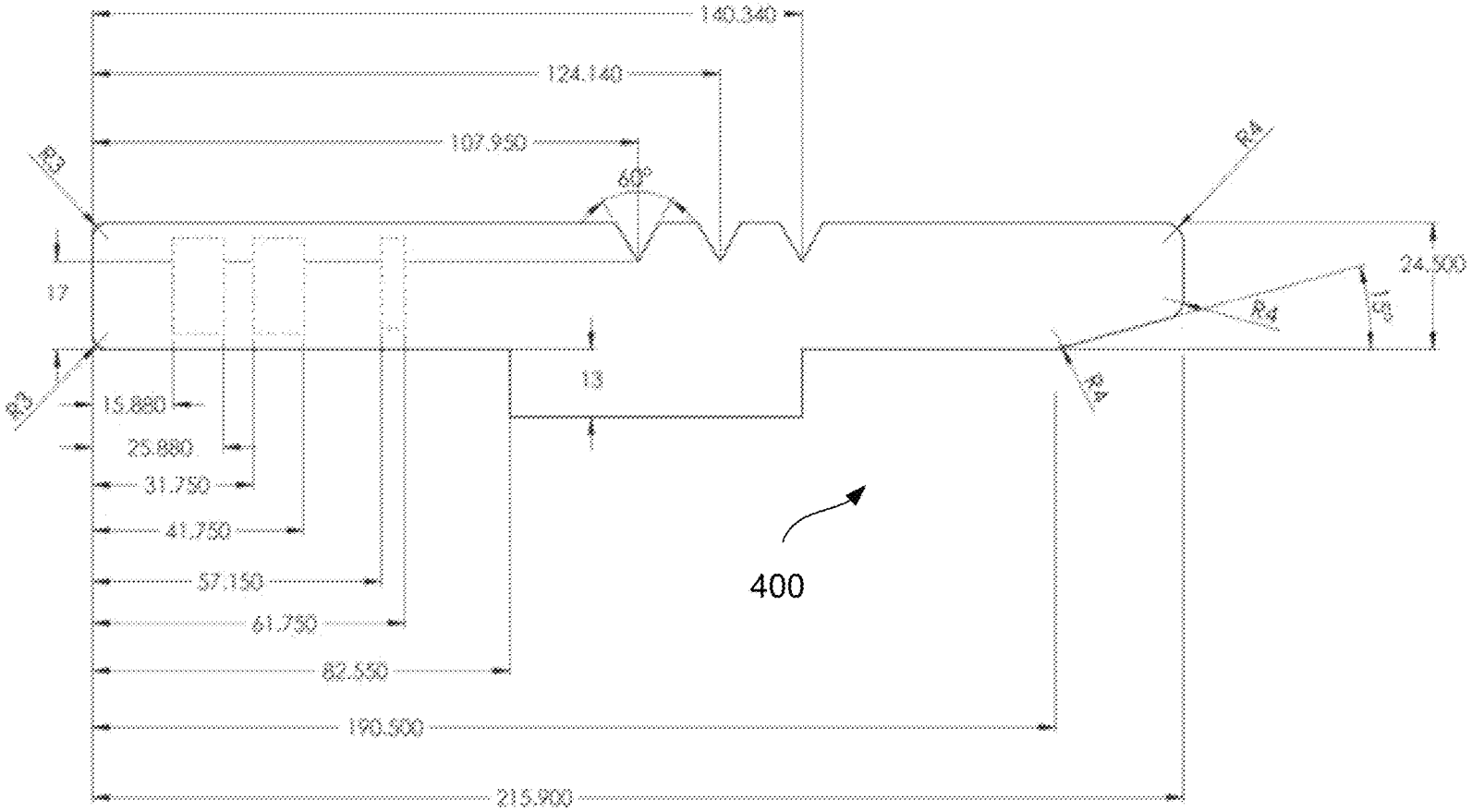

FIGS. 4A-4C illustrate yet another example of an insert device 400 in accordance with embodiments of the present disclosure. In some embodiments, device 400 is designed to be inverted & reversible, with slight modifications to the previous designs mentioned above. However, the placement of the three pontoons (312, 314, and 316), in this design, must always be on the lateral side of the shoe. This feature allows the ability to adapt to different shoe styles. In this example design, the contour has been modified from the previous curved topline to a straight linear measurement. The pontoons may be facing the interior or the exterior of the shoe wall (depending on the reversible orientation). However, the relationship of each of the pontoons to each other must be the same, thereby ensuring protection to the bony anatomical elements of the lateral side of the foot.

Insert device 400 includes medial wing 430, middle section 420, lateral wing 410, three pontoons (412, 414, and 416). Insert 400 also includes three truncated pyramids 422, or truncated crenalations, which serve to fit snugly under the sponge foam cushion installed by the manufacturer. The truncated crenalations serve a similar purpose to the three triangles in insert device 300. However, the truncated tips allow for the inverted option. In the inverted option the truncated pyramids are at the base of the heel contour of a shoe and they have the flexibility to adjust to this position, cradling the base line curvature of the floor of the shoe without leaving any spacing and not exposing the bulbous portion of the heel to the un-yielding heel cup. Insert 400 also includes extension 424 towards the plantar/bottom side of the middle section. Also while in the inverted option, extension 424 then protects the top of the heel, much like extension 222 of device 200. This serves to reinforce the entire heel where more protection is needed. In addition, this bottom extension 424 extends slightly in the lateral direction. This provides increased protection to the lateral side bottom of the heel. This is because more pressure is exerted onto the lateral side bottom of the heel during movement. In the inverted scenario, the staggered difference is also helpful due to the rear of the heel counter being wider at the top and narrower at the bottom the device is designed to fit this accommodation. The truncated elements 422 narrow when positioned properly at the base of the heel surface. When the squared extension 424 is at the top-line of the heel portion of the shoe it will be sheltered under the preexisting sponge foam rim, installed by the manufacture. The medial wing 430 includes a 15 degree arch towards the bottom distal end of the medial wing. This functions to follow the longitudinal arch of the medial side (arch side) of the foot.

For example purposes only, insert 400 is depicted as having pontoon 416 be thinner (horizontally) than the other two pontoons. This difference is depicted only to show that the pontoons do not all have to be the same size. However, the positions relative to each other must remain consistent because where the pontoons are placed is more important than how big the pontoons are. Thus, in some embodiments, insert device 400 can have varying size pontoons, as well as varying size truncated crenalations.

It should be noted that insert 400 is designed to be more versatile than other designs mentioned above, but consequently does not conform as precisely to the anatomical bones of the heel. In order to mitigate the effects of this deficiency, insert 400 is designed to bring more stability. Thus, insert 400 illustrates an ideal design for the minimalist shoe that is not designed for physical activity and thus needs much more support for the back of the heel.

As with FIG. 1B, FIG. 4B shows an edge view of insert 400. As with FIG. 1C, FIG. 4C provides example measurements for insert device 400. The example measurements are given in mm, but are not limiting for some embodiments of the present disclosure. Thus, real embodiments can have any combination of numbers as long as some of the same purposes or advantages of the insert device, as described herein, are achieved. It should be noted that the example measurements, e.g. height, in insert device 400 presented in FIG. 4C may be smaller than the measurements in FIGS. 1C, 2C, and 3C. This is to accommodate lesser dimensions in non-athletic/casual shoes.

FIG. 5A-5C

Figure 5A:
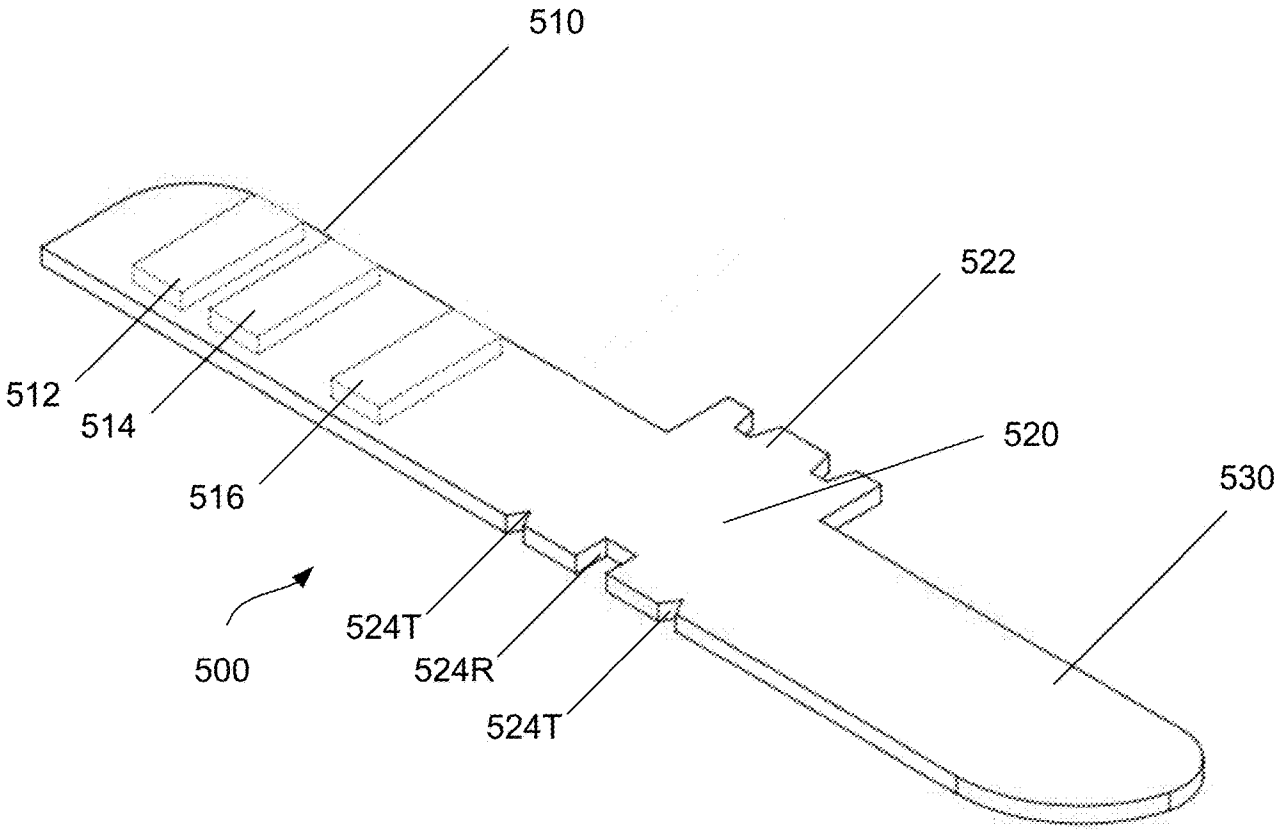
FIGS. 5A-5C illustrate another example of an augmented heel cup insert device in accordance with embodiments of the present disclosure.
Figure 5B:
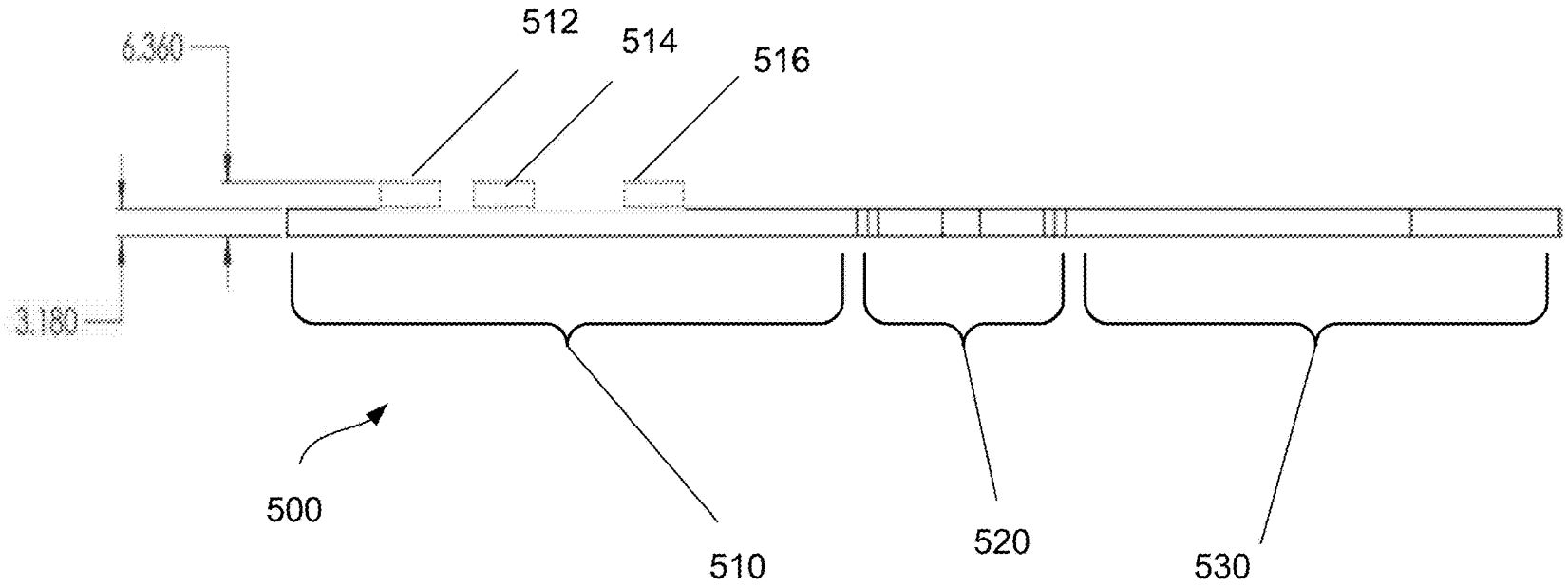
Figure 5C:
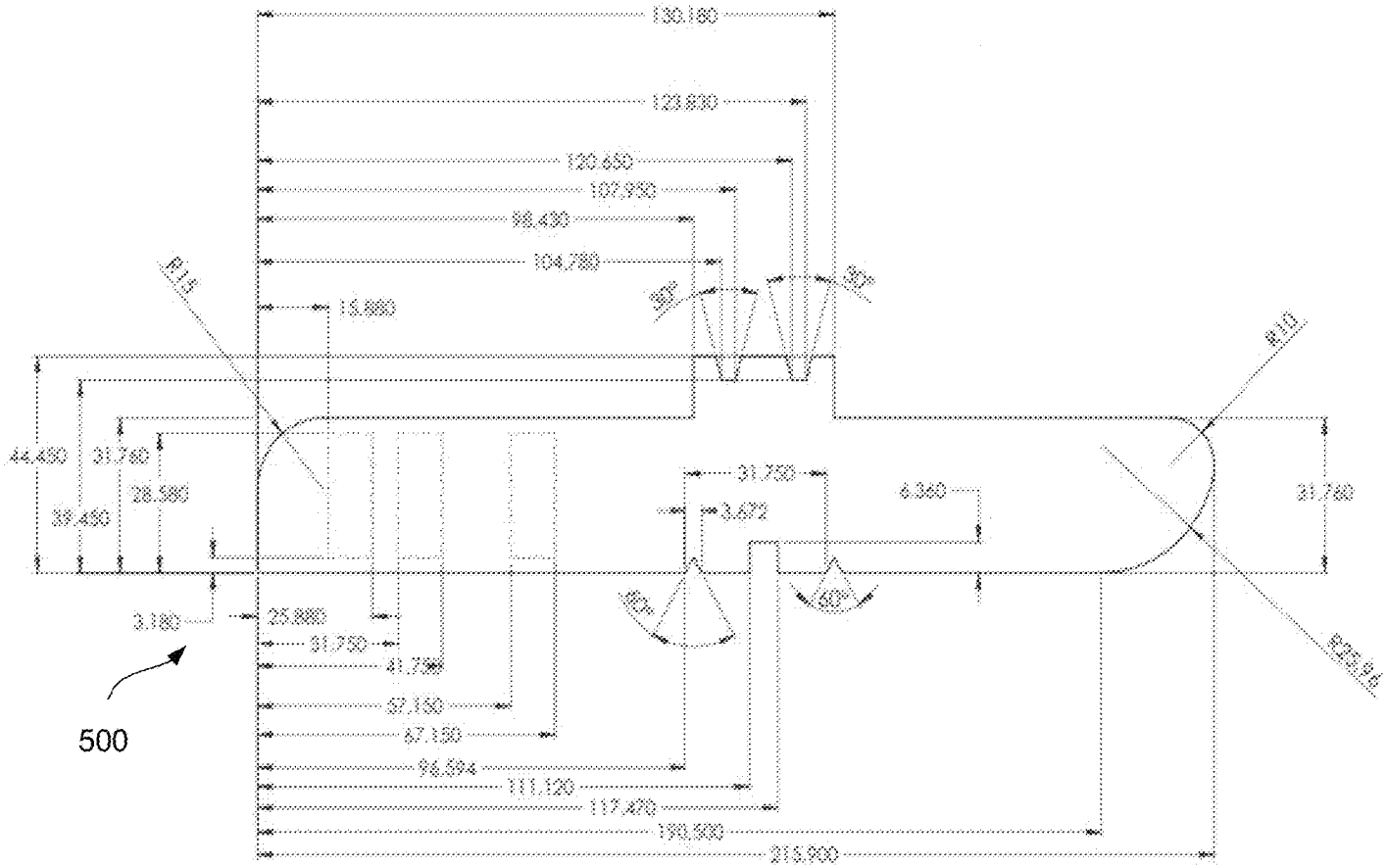

FIGS. 5A-5C illustrate yet another example of an insert device 500 in accordance with embodiments of the present disclosure. In some embodiments, insert device 500 is also designed to be inverted & reversible, with slight modifications to the previous designs mentioned above. This feature also allows the ability to adapt to different shoe styles. Insert device 500 includes medial wing 530, middle section 520, and lateral wing 510. On lateral sing 510 sit pontoons 512, 514, and 516.

In addition, top extension 522 is a semi-square extension with small truncated crenalations. Extension 522 is a blend of square extension 222 and truncated crenalation 422. As with truncated crenalations in FIGS. 4A-4C, the truncated crenalations are designed to be cradled under the sponge foam around the periphery of the shoe. This allows for more support of the tendoachilles (from the square extension) while allowing for the flexibility of the absorption wave abilities of the truncated crenalations.

Insert device 500 also includes notches 524 for facilitating bending of the insert device to fit perfectly into the heel cup portion of the shoes. As a non-limiting example, these notches 524 are presented as three distinct geometric cut-outs, designed to facilitate the installation and its adaptability to contour of a shoe. The example depicted in FIGS. 5A-5C depicts two acute triangles 524T and a rectangle 524R. Rectangular cut-out 524R at the mid-portion of device 500 is designed to fit irregular contours of the shoe and not to form any seam or irritating fold. NOTE: If a manufacturer chooses to invert the installation of device 500, the notches 524, as well as the extension 522 will fit irregular contours at the top and bottom of the shoe as well (thereby switching roles), which allows for device 500 to be readily adapted to inverted option. In some embodiments, insert device 500 provides the best combination of stability, protection, and versatility.

As with FIG. 1B, FIG. 5B shows an edge view of insert 500. As with FIG. 1C, FIG. 5C provides example measurements for insert device 500. The example measurements are given in mm, but are not limiting for some embodiments of the present disclosure. Thus, real embodiments can have any combination of numbers as long as some of the same purposes or advantages of the insert device, as described herein, are achieved.

Figure 6:
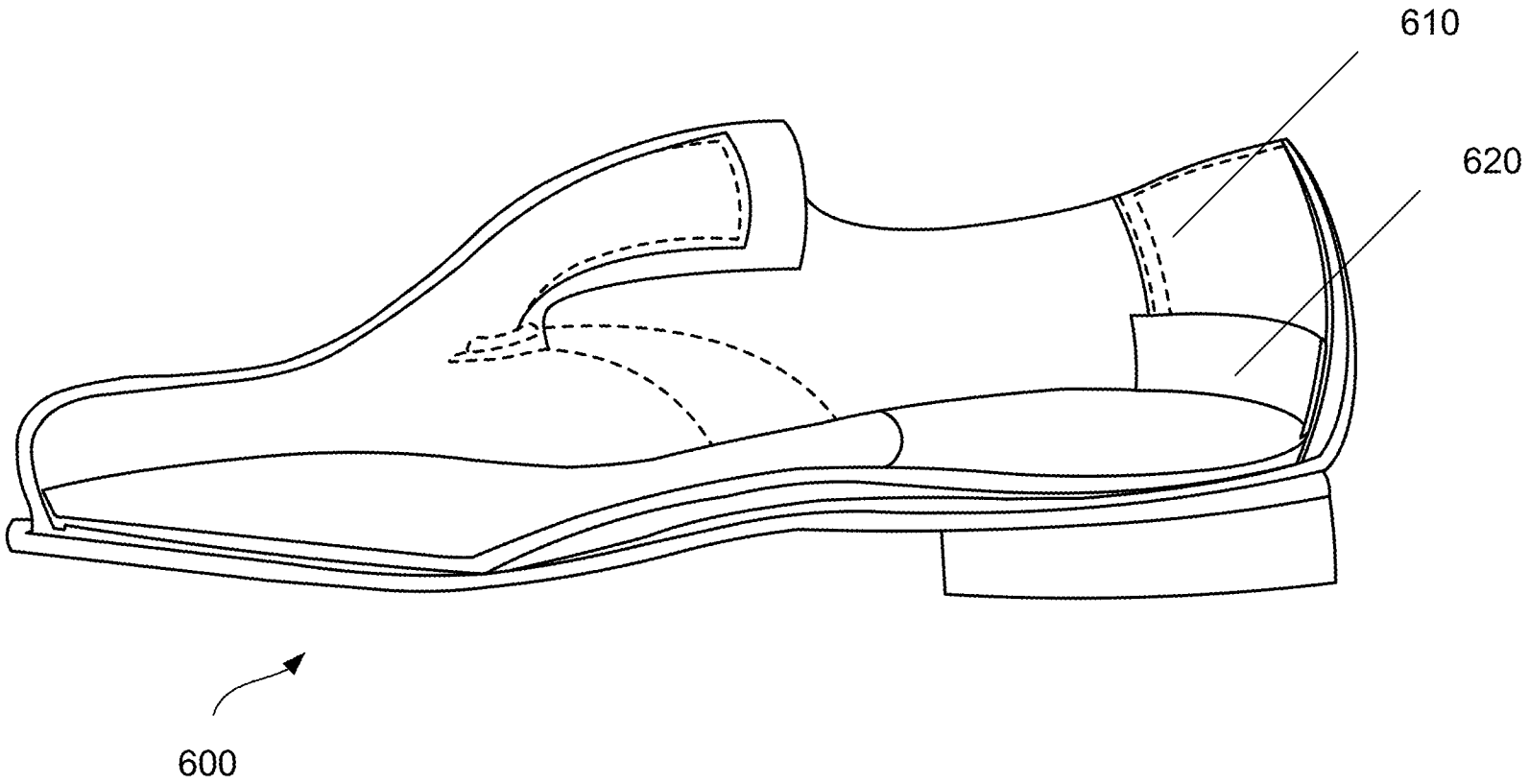
FIG. 6 illustrates an example shoe with an augmented heel cup insert installed in accordance with embodiments of the present disclosure.

FIG. 6 illustrates an example shoe with an augmented heel cup insert installed in accordance with embodiments of the present disclosure. Shoe 600 includes heel cup 610. Shoe 600 also includes insert 620 installed in shoe 600. Insert 620 can be any of the inserts described in the present disclosure. For example, insert 620 can be insert 100, 200, 300, 400, or 500.

In Conclusion: In various embodiments, the insert devices, by virtue of its designs, are effective and efficient in design. In some embodiments, the device addresses the issues of comfort, protection, and stability of the heel segment. In some embodiments, the device furthermore extends the durability of the shoe's inner structure.

The foregoing description, for purpose of explanation, has been described with reference to specific embodiments. However, the illustrative discussions above are not intended to be exhaustive or to limit the present disclosure to the precise forms disclosed. Many modifications and variations are possible in view of the above teachings. For example, any combination of feature from any of the figures can be used as embodiments of the present disclosure. The embodiments were chosen and described in order to best explain the principles of the present disclosure and its practical applications, to thereby enable others skilled in the art to best utilize the present disclosure and various embodiments with various modifications as are suited to the particular use contemplated.

What is claimed is:

1. An augmented heel cup protective insert device for shoes, comprising:

a middle section configured to correspond to the curvature of a heel of a shoe, wherein the middle section includes a semi-square extension for providing tendoachilles support, the semi-square extension including truncated crenalations designed to be cradled under a periphery of the shoe for absorbing side-to-side foot movement;

a medial wing; and a lateral wing including pontoons, wherein only the lateral wing includes pontoons;

wherein the device includes three distinct geometric cut-outs designed to facilitate installation and adaptability to the contour of the shoe, wherein the geometric cut-outs include a rectangular cut-out in the middle of the device designed to fit irregular contours of shoes.

2. The device of claim 1, wherein the device comprises material to alleviate strain or pressure applied to the heel of a wearer.

3. The device of claim 1, wherein the device is configured to be cemented to the heel cup portion of the shoe.

4. The device of claim 1, wherein the device is configured to be inserted in between the heel cup and the lining of the shoe such that the device cannot be readily removed from the shoe without removing a portion of the shoe lining.

5. The device of claim 1, wherein the pontoons are strategically placed on the lateral wing to provide protection to vulnerable areas of the lateral side of a foot.

6. The device of claim 1, wherein the rectangular cut-out is surrounded on both sides by acute triangular cut-outs.

7. The device of claim 1, wherein the device made of a material comprising one or more of the following: polyethylene, polyurethane, foam rubber, and neoprene.

8. The device of claim 1, wherein the pontoons are strategically placed on the lateral wing such that the pontoons straddle a calcaneal prominent tubercle of a foot when the shoe with the insert device is worn.

9. The device of claim 1, wherein the pontoons include a distal pontoon, a middle pontoon, and a proximate pontoon.

10. The device of claim 9, wherein the distal pontoon is positioned to provide ancillary protection to soft tissue posterior to the cuboid bone, the middle pontoon is positioned to protect the calcaneal tubercle, and the proximal pontoon is positioned to provide ancillary protection to heel tissue.

11. A shoe, comprising:

a heel cup; and an augmented heel cup protective insert device cemented to the heel cup, the insert device including:

a middle section configured to correspond to the curvature of a heel of a shoe, wherein the middle section includes a semi-square extension for providing tendoachilles support, the semi-square extension including truncated crenalations designed to be cradled under a periphery of the shoe for absorbing side-to-side foot movement;

a medial wing; and a lateral wing including pontoons, wherein only the lateral wing includes pontoons;

wherein the device includes three distinct geometric cut-outs designed to facilitate installation and adaptability to the contour of the shoe, wherein the geometric cut-outs include a rectangular cut-out in the middle of the device designed to fit irregular contours of shoes.

12. The shoe of claim 11, wherein the device comprises material to alleviate strain or pressure applied to the heel of a wearer.

13. The shoe of claim 11, wherein the device is configured to be cemented to the heel cup portion of the shoe.

14. The shoe of claim 11, wherein the device is configured to be inserted in between the heel cup and the lining of the shoe such that the device cannot be readily removed from the shoe without removing a portion of the shoe lining.

15. The shoe of claim 11, wherein the pontoons are strategically placed on the lateral wing to provide protection to vulnerable areas of the lateral side of a foot.

16. The shoe of claim 11, wherein the rectangular cut-out is surrounded on both sides by acute triangular cut-outs.

17. The shoe of claim 11, wherein the device made of a material comprising one or more of the following: polyethylene, polyurethane, foam rubber, and neoprene.

18. The shoe of claim 11, wherein the device further comprises pontoons are strategically placed on the lateral wing such that the pontoons straddle a calcaneal prominent tubercle of a foot when the shoe with the insert device is worn.

19. The shoe of claim 11, wherein the pontoons include a distal pontoon, a middle pontoon, and a proximate pontoon.

20. The shoe of claim 19, wherein the distal pontoon is positioned to provide ancillary protection to soft tissue posterior to the cuboid bone, the middle pontoon is positioned to protect the calcaneal tubercle, and the proximal pontoon is positioned to provide ancillary protection to heel tissue.

* * * * *